United States Patent [19]

Kocsi

[11] Patent Number: 4,989,014

[45] Date of Patent: Jan. 29, 1991

[54] RECEPTION ANTENNA SYSTEM

[76] Inventor: Louis Kocsi, 25 Palisade Ave., Garfield, N.J. 07026

[21] Appl. No.: 432,209

[22] Filed: Nov. 6, 1989

Related U.S. Application Data

[63] Continuation-in-part of Ser. No. 293,976, Jan. 6, 1989, abandoned, which is a continuation-in-part of Ser. No. 40,847, Apr. 20, 1987.

[51] Int. Cl.[5] ..... H01Q 11/12

[52] U.S. Cl. ..... 343/742; 343/834

[58] Field of Search ..... 343/742, 741, 743, 744, 343/866, 867, 834

[56] References Cited

U.S. PATENT DOCUMENTS 4,160,980 7/1979 Murray ..... 343/79

4,584,586 4/1986 Kocsi ..... 343/742

*Primary Examiner*—Rolf Hille

*Assistant Examiner*—Hoanganh Le

*Attorney, Agent, or Firm*—M. K. Silverman

[57] ABSTRACT

A reception antenna system for electrical connection to the positive and negative sides of a transmission feedline employed in television and other telecommunications includes a reflector having a conductive surface and further having a circumferential raised edge to provide reflected signals to the reflector. The system includes an even group of electrically open-ended radial pairs, having positive and negative ends, of hollow, substantially scalene triangular conductive loops, each loop of each pair being internally symmetric about a radius of the reflector, each pair of the group disposed at an uniform offset from the surface of the reflector, the offset defined by insulative mounting elements. Upon the reflector are elements for electrically connecting one negative end and one of the open-ended loop pairs to an adjacent negative end of another of the loop pairs to thereby define at least two loop pairs, each of which two pairs define a single conductive array which is electrically, but not radiationally, discreet from the reflector. One end of each loop is connected to a corresponding positive or negative side respectively of the transmission feedline. The electromagnetic geometry of the loop pairs of will substantially amplify signals received from the reflector and, further, will receive and amplify signals independently of the reflector.

12 Claims, 8 Drawing Sheets

RECEPTION ANTENNA SYSTEM

REFERENCE TO RELATED APPLICATION

This case is a Continuation-in-Part of Application Ser. No. 07/293,976, filed Jan. 6, 1989, now abandoned, which is a Continuation-in-Part of Application Ser. No. 07/040,847, filed Apr. 20, 1987.

BACKGROUND OF THE INVENTION

The present invention relates to a multi-turn loop reception antenna adapted for use in combination with a reflector element. Such reflector elements, also known as parabolic dishes or earth stations, have been long known in the art as a primary means of receiving signals which have been reflected off of satellites placed in geosynchronous orbit about the earth. Since the development of such parabolic antennas, a need in the art has been that of reducing the size and cost of such structures to make their usage more practical for use by the general public. Accordingly, the instant invention may be view as a response to this need in the art.

The general approach of the invention herein is that of the combination of certain plural antenna elements with a flat disc-like reflector. More particularly, the inventor herein has improved upon his technology relating to the use of symmetric pairs of hollow, substantially scalene triangular antenna loops as set forth in his U.S. Pat. No. 4,584,586.

To the knowledge of the inventor, the only prior art which has made use of any combination of reflective and non-reflective elements within a single antenna system appears in U.S. Pat. No. 4,095,230 (1978) to Salmond, entitled High Accuracy Board Band Antenna System; and No. 4,160,980 (1979) to Murray, entitled Dipole Antenna and Parabolic Reflector. The reference to Salmond employes a substantially flat reflector in combination with secondary antenna components. This reference to Salmond is apparently of utility only in the tracking of targets by a ground-to-air or air-to-air missile, while the patent to Murray is apparently relevant only to UHF reception.

SUMMARY OF THE INVENTION

The invention is directed to a reception antenna system for electrical connection to the positive and negative sides of a transmission feedline of the type employed in television and other telecommunications. The system comprises a reflector having a conductive surface and further having circumferential raised edges which assist in the operation of the reflector. The system includes an even plurality of electrically open-ended radial pairs, having positive and negative ends, of hollow, substantially scalene triangular conductive loops, each loop of each pair being internally symmetric about a radius of said reflector, each pair of said plurality disposed at a uniform offset from the surface of said reflector, said offset comprising insulative mounting means. Upon said reflector are means for electrically connecting one positive end of one of said open-ended loop pairs to an adjacent positive end of another of said loop pairs to thereby define at least two loop pairs, each of which two pairs comprise a single conductive array which is electrically, but not radiationally, discreet from said reflector. One end of each loop pair is connected to a corresponding positive or negative side respectively of the transmission feedline. The electromagnetic geometry of said loop pairs in combination with said conductive surfaces will substantially amplify signals received from said reflector, and further, will receive and amplify signals independently of said reflector.

It is an object of the present invention to provide a plural element reflector reception antenna having improved signal gain and cost-effectiveness over the prior art.

It is another object of the present invention to provide a plural element reception antenna having a reflector that will provide improved area/volume effectiveness over prior art reflector reception antennas.

It is a further object to provide an antenna that will provide a high gain over a frequency band encompassing all VHF and UHF frequencies.

It is yet further object to provide an antenna which will retain its original performance and efficiency ever after a prolonged exposure to adverse weather.

A still further object is to provide a plural element antenna comprising a combined multi-loop and reflector antenna having an improved mechanical design that will provide a maximum frontal area for magnetic field induction. The above and yet other objects and advantages of the present invention will become apparent from the hereinafter set forth Drawings, Specification and Claims appended herewith.

DETAILED DESCRIPTION OF THE INVENTION

Figure 1:
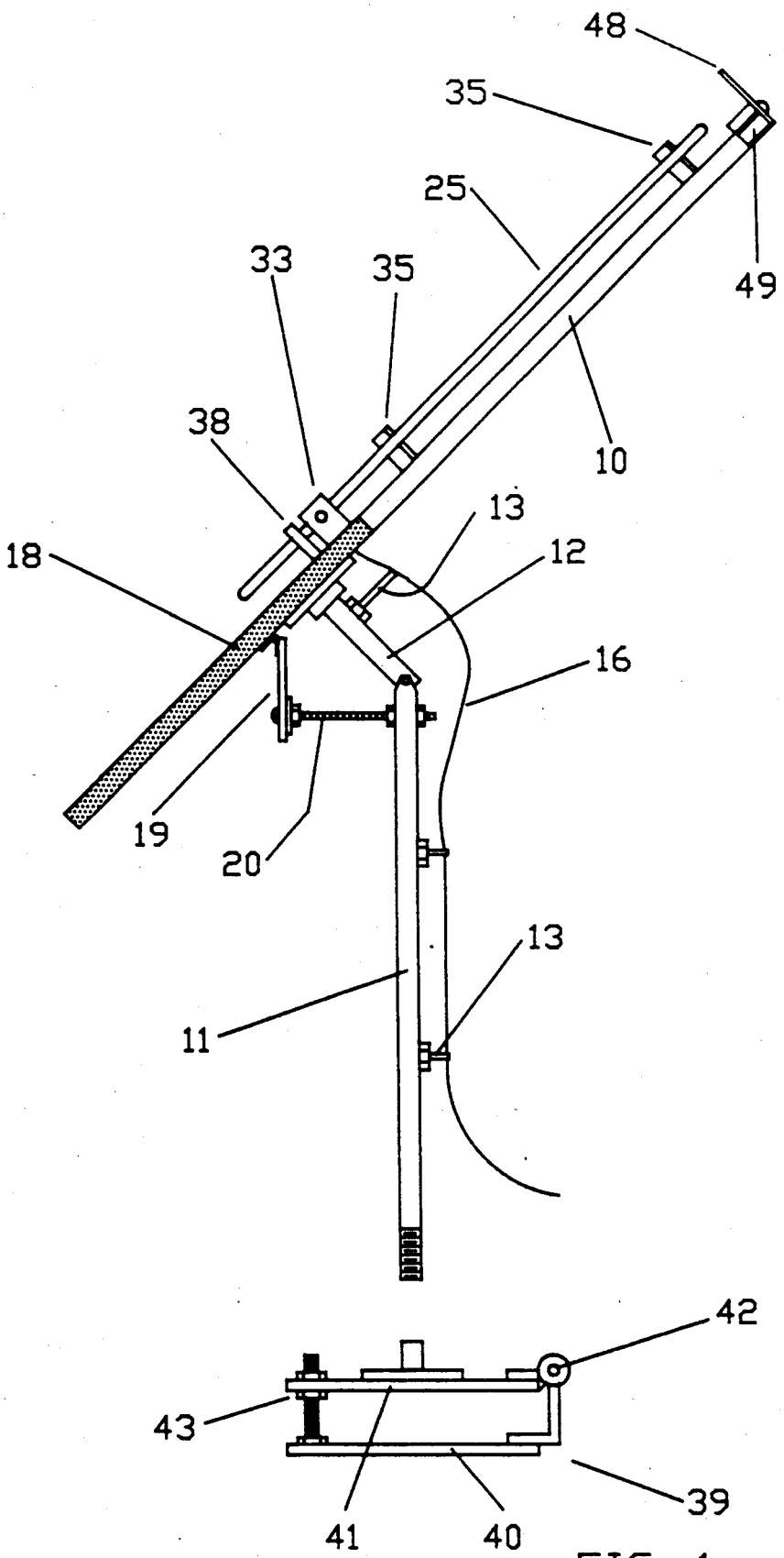
FIG. 1 is a side cross-sectional diametric view of the inventive antenna system.

With reference to FIG. 1 there is shown a reception antenna system which includes a reflector 10 having a center region 18 which region is rigidly mounted upon an upper post element 12 which, in turn, is rotationally coupled unto a lower post element 11.

Figure 2:
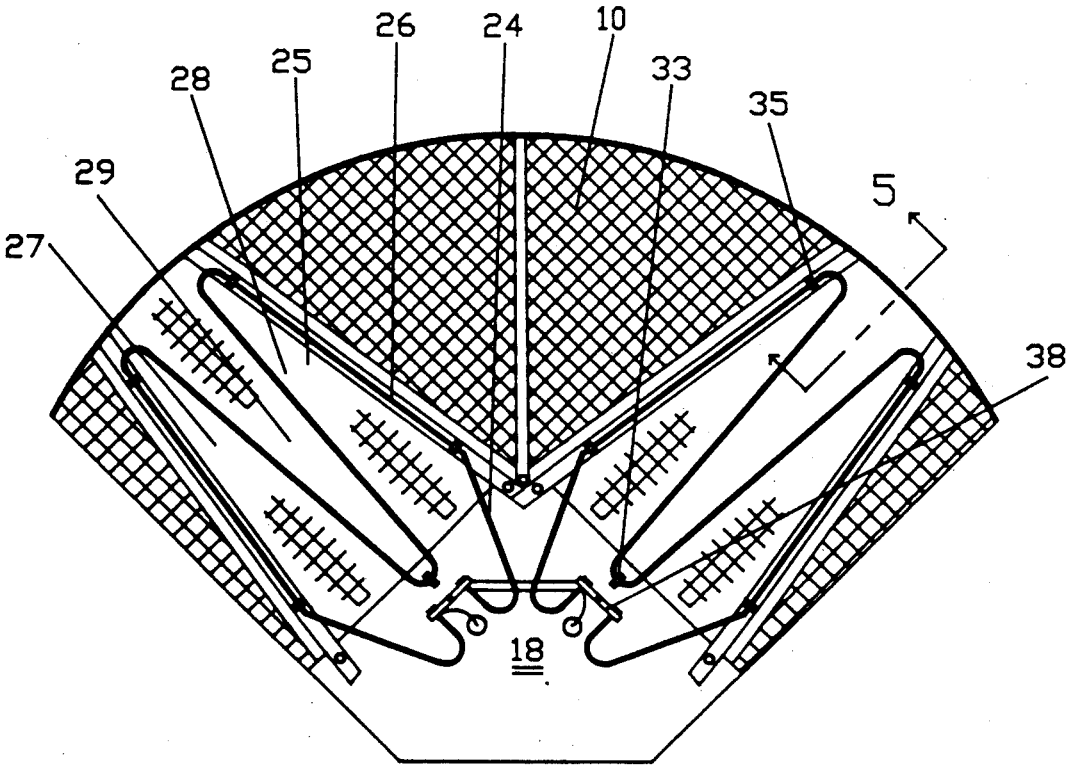
FIG. 2 is a front axial view of the reflector portion.
Figure 3:
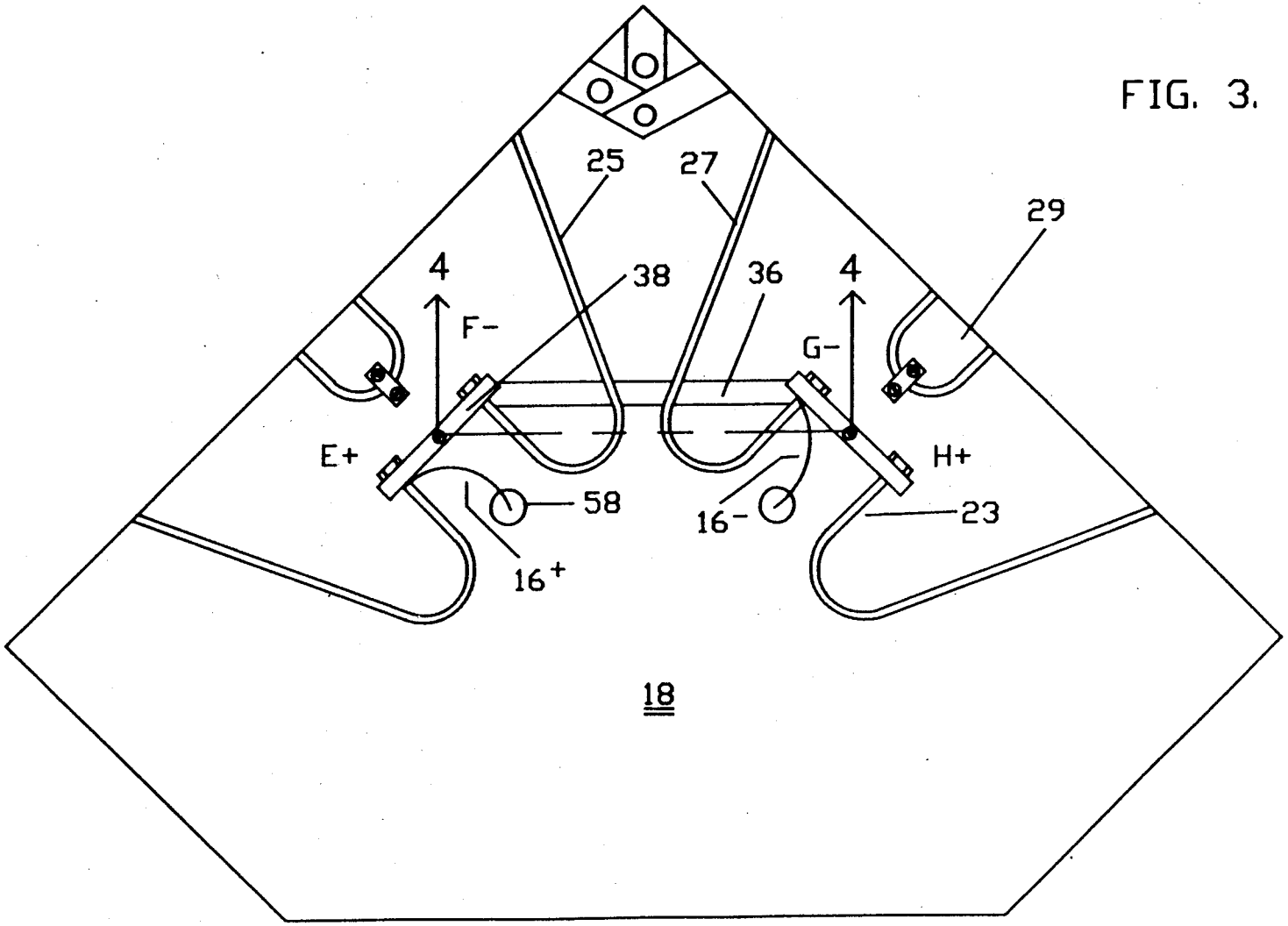
FIG. 3 is an enlarged axial plan view of part of the loop-end conductor assembly shown at the center of FIG. 2.

With respect to the views of FIGS. 2 and 3, it may be seen that positive and negative sides of feed line cable 16 extend through said center region 18 of a reflector 10, passing through holes 58 and, therefrom, into electrical connection with ends 23 of open-ended radial pairs 29 of hollow substantially scalane triangular conductive loops 25 and 27. Also shown is connector 36 which electrically connects the negative end of the conductive loops.

As may be noted in FIG. 2, each loop of each pair is internally symmetric about a radius of said reflector 10. For example, loop 25 of loop pair 29 is symmetric with loop 27 of loop pairs 29. In addition, each loop pair of said plurality of loop pair is disposed up a plane which is substantially parallel with, and at a uniform offset from, the surface of reflector 10 and at center region 18.

This offset is achieved through the use of a plurality of mounting and insulation means 33, 35 and 38 (see FIGS. 1, 2, 3, 9 and 10), each of which are disposed at different radial distances from said axial center line of the reflector, but along an axis of radial symmetry of one loop pair.

It should be appreciated that the surface of reflector 10 and its center region 18 is conductive. In a preferred embodiment, the substrate of the reflector and its center region will be formed of a fiberglass material to which a conductive coating is then applied. Thereupon, may optionally be applied a mesh like layer of conductive filaments.

Figure 6:
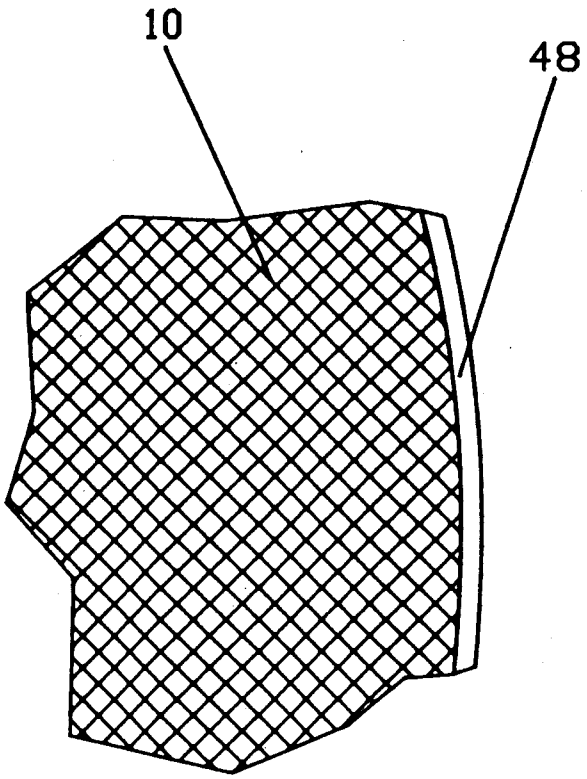
FIG. 6 is an enlarged perspective view of an outer area of the reflector.
Figure 5:
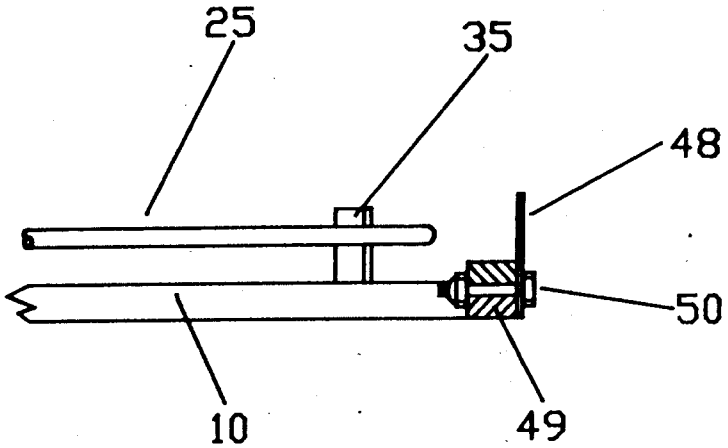
FIG. 5 is an enlarged breakaway view of the radial end of a loop pair of the antenna, taken along Line 5—5 of FIG. 2.

With reference to FIGS. 1, 5 and 6, it may be noted that an outer circumferential edge 48 of reflector 10 comprises a circumferential raised edge in the character of the wall of a cylinder in which the reflector comprises the base of such cylinder. This edge 48 of the antenna system circumscribed a curved surface which, at all times, is perpendicular to the plane of reflector 10. As may be noted in FIG. 5, the circumferential edge 48 is secured to reflector 10 through the use of circumferential block element 49 which, through the use of a self-tapping screw and nut 50, secures edge 48 to reflector 10. Further shown in FIG. 5 is mounting and insulation means 35. Edge 48 also operates to secure in place any mesh employed upon reflector 10.

With reference to the view of FIG. 3, there is shown integral with reflector 10, said center region 18 upon which are provided means for electrically connecting one negative end 23 (see also FIG. 9) of one of said open ended loop pairs 29 to an adjacent negative end of another end of said loop pairs to thereby define at least two loop pairs. See electrical connector 36 in FIGS. 3 and 4. It is to be appreciated that each of said two loop pairs comprises a single conductive array which is electrically, but not radiationally, discreet from said reflector, and that each of said two loop pairs are connected at electrically opposite polarities to positive and negative sides respectively of positive and negative pairs of transmission feed line cable 16. Consequently, the electromagnetic geometry of said loop pairs 29 in combination with the conductive reflector 10 will amplify signals received from the atmosphere. In addition, it has been found that said loop pairs 29 receive and amplify signals, although less efficiently, independently of the conductivity of said reflector.

Further, said circumferential edge 48 of the antenna system will act to reflect inwardly, to said loop pair system, electromagnetic energy recieved near the outer radius of the reflector.

The reflector 10 may comprise a substantially flat surface although, if preferred, a parabolic surface may be employed in the alternative.

Figure 9:
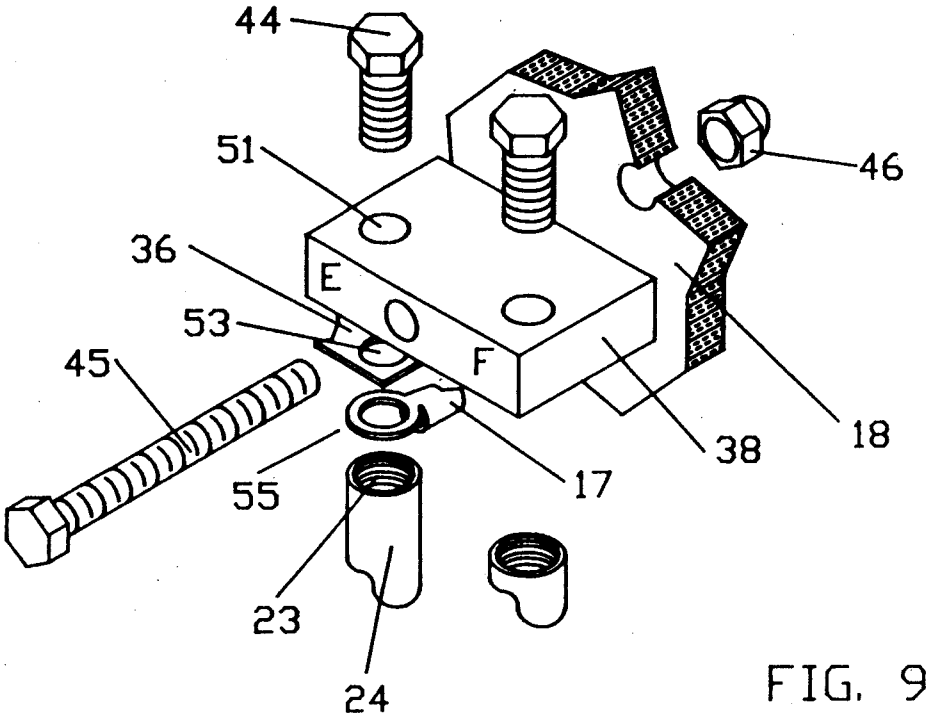
FIG. 9 is an exploded view of the center insulator and its offset means, showing connection to one loop pair.

As may be noted, each loop pair 29 has two open ends 23 (see FIGS. 3 and 9). The polarity of these open ends alternate between positive and negative in the manner shown in FIG. 3. Therein, it may be noted, that feed line cable 16 connects to loop ends E and G. It may be noted inf FIGS. 2 and 3 that successive negative ends 23 of open ended radial pairs 29 are connected to each other, e.g., connection EF and connection GH. Thereby, as above noted, the result is that of two conductive surfaces which are electrically, but not radiationally discreet, from the reflector surface.

In certain applications it has been found desirable to use one loop pair for purposes of one form of telecommunications, e.g., television reception, and to use a second loop pair for a different type of telecommunication reception, e.g., cellular telephone reception.

A more complete explanation of the electromagnetic operation of the loop-pair geometry employed herein is provided in my U.S. Pat. No. 4,584,586.

With further reference to FIG. 2, it is to be appreciated that each triangular loop 25 and 27 is provided with a first small leg 24, an intermediate length leg 26, and a virtual hypotenuse 28. In a preferred embodiment, the length of said legs 24, 26 and 28 will have a ratio of one-to-two-to-three, as between the smallest, intermediate, and hypotenuse legs thereof.

Figure 4:
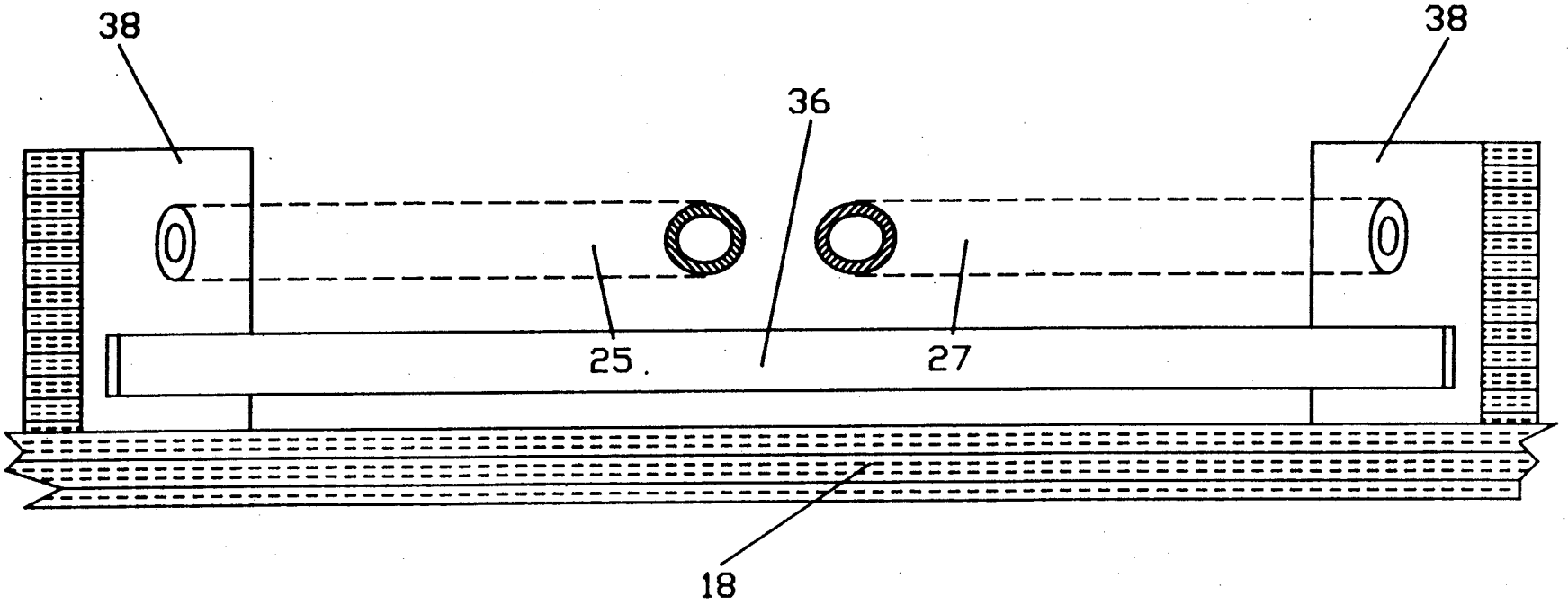
FIG. 4 is a cross-sectional view taken long Line 4—4 of FIG. 3.

Shown in FIG. 9 is a Segment EF of the connecting and mounting assembly 38 which, specifically, shows a connection of positive cable 17, and its terminal 55 to ends 23 of leg 24 of loop 25 of radial loop pair 29. Thereby, end 23 of loop pair 24 is connected to feed line cable 16 and, as well, to conductor 36, which as is shown in the views of FIGS. 3 and 4, will connect the loop pair in the lower right hand corner of FIG. 3 to the loop pair in the top of FIG. 3 by the connection of loop end E to loop end F.

As may be further noted in FIG. 9, a simple combination of hex bolts 45 and wing nuts 46 may be employed to effect the securement of insulator 38 to center region 18 and, similarly, a nut 44 may be easily threaded through hole 51 of insulator 38, hole 53 of conductor 36, circular end 55 of feed line cable 17 and, therefrom, into end 23 of loop leg 24 to thereby create a secure electrical conduction between said elements and, thereby, provide the electrical connection necessary to form the above defined systems.

Figure 10:
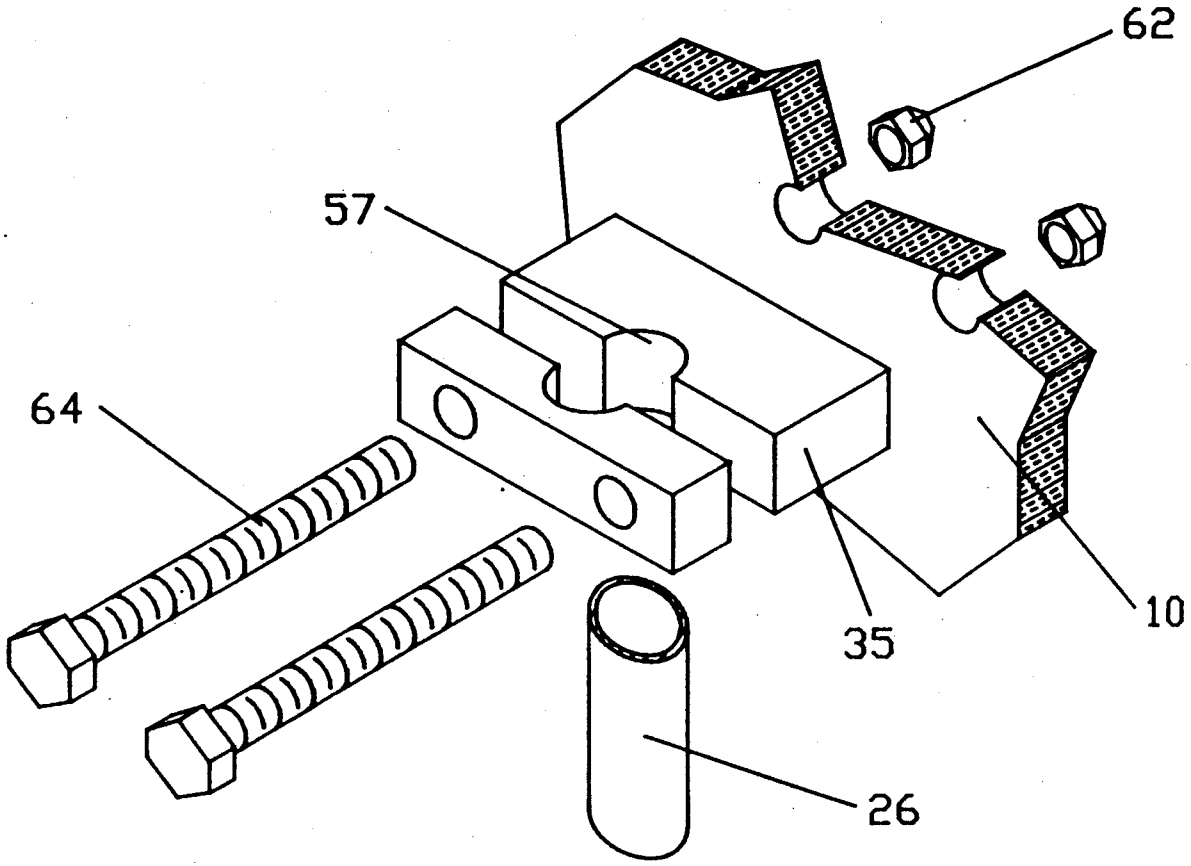
FIG. 10 is an exploded view of the outermost insulator assembly.

With respect to the view of FIG. 10, there is shown, in exploded view, the hardware associated with outer mounting and insulation means 35 (see also FIG. 2). In FIG. 10, it is noted that through the use of wing nut 62 and hexbolts 64, loop leg 26 of loop 25 may be readily secured within opening 57 of mounting element 35.

As above noted, it has been found that the inventive antenna system does not require a curved or parabolic reflector but, rather, will function satisfactorily with the use of a substantially flat reflector. Accordingly, a substantial savings, from a production and cost point of view, is effectuated in the dispensation of a parabolic reflector. Additionally, it has been found that loop pairs 29 may be formed of a metallic tubing such as aluminum and that, in one embodiment, a 0.375 guage aluminum tubing having an internal diameter of 0.325 inches has been found suitable. The tubing is shown cross-section in the view of FIGS. 9 and 10.

Figure 8:
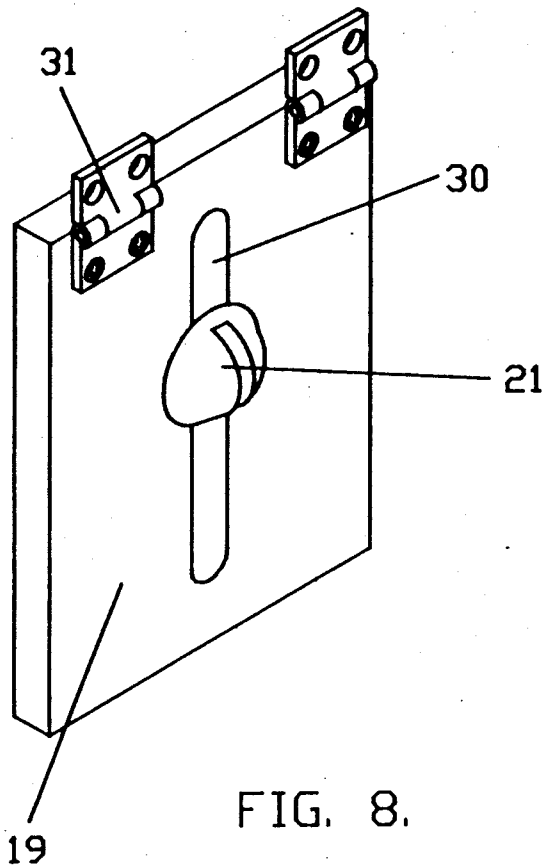
FIG. 8 is a perspective view of the antenna adjustment means.

Included within the present reception system are means for selectively changing the angulation of the axial center line of the reflector relative to a supporting plane of the reflector, for example, relative to the plane of a roof or ground to which the reflector may be secured. More particularly, with reference to the views of FIGS. 1 and 8, an antenna attitude change assembly 19 may be seen to include a slot element 30 and hinge means 31. With further reference to the system view of FIG. 1, it is seen that a transverse bolt and nut assembly 20 connects slot 20 to the upper end of lower post element 11. Accordingly, through the selective tightening and loosing of holding bolt 21, control assembly 19 will move upward or downward, within slot 30, thereby changing the angulation off the reflector relative to the supporting plane of reference.

Also shown, at the bottom of FIG. 1, is a second attitude control assembly 39 which comprises a lower base 40, an upper base 41, hinge means 42, and bolt means 43. Thereby, the angulation between the plane of lower base 40 and of upper base 41 may be selectively varied by changing the position of opposing ends of the upper and lower bases using bolt means 43. Thereby the entire assembly may be easily tilted to compensate for tilt or angulation of the supporting plane.

The second attitude control assembly is most useful where, for example, it is necessary to position the antenna system on top of a slanted roof. Accordingly, through the use of the second attitude control assembly 39, the tilt of the roof can be completely compensated for, such that the upper attitude control assembly 19 may be employed for fine adjustments, and the like, after the antenna system has been secured upon the desired supporting plane.

Figure 7:
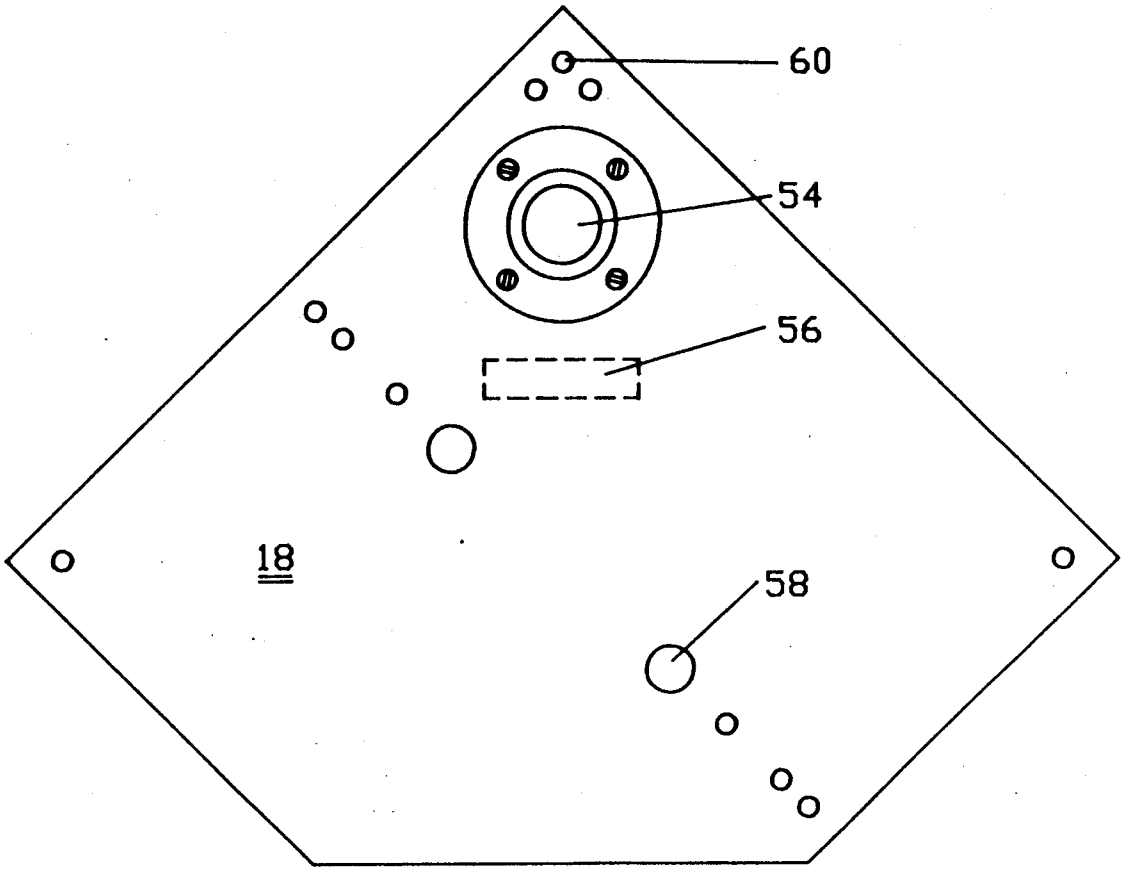
FIG. 7 is a plan view of the back center portion of the antenna.

With reference to FIG. 7, there is shown a rear view of the center portion 18 and, therein, may be seen holes 58 through which the feedline transmission cables reach ends 23 of the loop pairs 29. Also shown in FIG. 7 is recess 54 within which upper post element 12 is secured. Further shown in said figure are insulator support holes 60 into which bolts supporting insulation means 33 may pass.

Accordingly, while there has been shown and described a preferred embodiment of the present invention, it will be understood that the invention may be embodied otherwise than is herein specifically illustrated and described and that, within said embodiment, certain changes in the detail and construction, and in the form and arrangement of the parts, may be made without departing from the underlying ideas or principles of this invention within the scope of the appended Claims.

Having thus described my invention, what we claim as new, useful, and non-obvious and, accordingly, secure by Letters Patent of the United States is:

1. A reception antenna system for electrical connection to the positive and negative sides of a transmission feedline, said system comprising:

(a) a reflector defined by one-quarter of a polar segment of a circle, said reflector further having circumferential raised edges providing reflected electromagnetic radiation patterns to said reflector;

(b) at least two electrically conductive open-end radial loop pairs, having positive and negative ends, of hollow substantially scalene triangular loops, each loop of each pair being internally symmetric about a radius of said reflector, and said loop pairs uniformly offset from said reflector by insulative mounting means; and (c) upon said reflector, means for electrically connecting one negative end of one of said open ended loop pairs to an adjacent negative end of another of said loop pairs to thereby define at least two loop pairs, each of said two loop pairs comprising a single conductive array which is electrically, but not radiationally, discreet from said reflector, and in which one loop end of each loop pair is connected to a corresponding positive or negative side respectively of said transmission feedline, whereby the electromagnetic geometry of said conductive loop pairs of said conductive array will amplify signals received from said reflector to provide an effective reception antenna system.

2. The reception antenna system as recited in Claim 1, in which said raised circumferential edges comprise, in radial cross-section, walls of a cylinder in which said reflector comprises a base thereof, whereby said raised circumferential wall acts to reflect inwardly, to said loop-pair conductive surface, energy received near the outer edge of said reflector.

3. The reception antenna system as recited in Claim 2, in which said reflector comprises a substantially flat surface.

4. The reception antenna system recited in Claim 3, in which the legs of each of said scalene triangle loops define a ratio of one-to-two-to-three as between the smallest, intermediate, and hypotenuse legs thereof.

5. The reception antenna system as recited in Claim 4, in which said loops of said loop pairs comprise aluminum tubing.

6. The system as recited in Claim 4, in which said system further comprises: reflector means for selectively changing the angulation of a plane of said reflector relative to a supporting plane of reference such as a roof or ground.

7. The system as recited in Claim 4 in which said reflector includes a covering of mesh coating of conductive fibers.

8. The system as recited in Claim 3 in which said reflector includes a covering of mesh coating of conductive fibers.

9. The system as recited in Claim 2, in which said reflector comprises a parabolic surface.

10. The reception antenna system as recited in Claim 9, in which said reflector comprises a substantially flat surface.

11. The system as recited in Claim 10, in which said system further comprises; reflector means for selectively changing the angulation of a plane of said reflector relative to a supporting plane of reference such as a roof or ground.

12. The system as recited in Claim 9 in which said reflector includes a covering of mesh coating of conductive fibers.

* * * * *